US008265492B2

(12) United States Patent
Ueno

(10) Patent No.: US 8,265,492 B2
(45) Date of Patent: Sep. 11, 2012

(54) IMAGE FORMING SYSTEM AND SERVICE PERSON SUPPORT METHOD THEREFOR

(75) Inventor: Takashi Ueno, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 1140 days.

(21) Appl. No.: 11/694,064

(22) Filed: Mar. 30, 2007

(65) Prior Publication Data

US 2007/0244928 A1 Oct. 18, 2007

(30) Foreign Application Priority Data

Mar. 31, 2006 (JP) ..... 2006-098773

(51) Int. Cl.
*G03G 15/00* (2006.01)

(52) U.S. Cl. ..... 399/11; 399/18; 399/81

(58) Field of Classification Search ..... 399/11, 399/18, 9, 38, 44, 45, 75, 81
See application file for complete search history.

(56) References Cited

U.S. PATENT DOCUMENTS

| | | | | |
|---|---|---|---|---|
| 4,682,158 | A * | 7/1987 | Ito et al. | 340/679 |
| 5,138,377 | A * | 8/1992 | Smith et al. | 399/11 |
| 5,303,005 | A * | 4/1994 | Takano et al. | 399/8 |
| 2005/0177341 | A1 | 8/2005 | Wada | |
| 2005/0240376 | A1 | 10/2005 | Uwatoko et al. | |

FOREIGN PATENT DOCUMENTS

| | | | |
|---|---|---|---|
| JP | 01-269551 | A | 10/1989 |
| JP | 03-226772 | A | 10/1991 |
| JP | 05-053389 | A | 3/1993 |
| JP | 2006-053389 | A | 5/1993 |
| JP | 10-301947 | A | 11/1998 |
| JP | 2005-309078 | A | 11/2005 |
| JP | 2006-017765 | A | 1/2006 |
| WO | 03-105039 | A1 | 12/2003 |

* cited by examiner

*Primary Examiner* — Walter L Lindsay, Jr.
*Assistant Examiner* — Benjamin Schmitt
(74) *Attorney, Agent, or Firm* — Canon USA, Inc., I.P. Division

(57) ABSTRACT

An image forming system which enables a service person to accurately and promptly replace or adjust a faulty component part of an image forming apparatus at the occurrence of a malfunction or during a periodic inspection. An external storage device stores to-do items and reference data. A service person performs a malfunction-correcting operation according to each to-do-item sent from the central control unit in response to his request via the image forming apparatus. Upon receipt of data input by the service person according to the to-do-item, the central control unit generates a synthetic data of the input data and the reference data. Based on the synthetic data, the service person determines whether or not a malfunction is corrected or the present to-do-item is cleared, and performs part replacement/adjustment, if necessary, to input new check/measurement data, which is sent to the central control unit again. This process is continued until the malfunction is corrected.

16 Claims, 10 Drawing Sheets

IMAGE FORMING SYSTEM AND SERVICE PERSON SUPPORT METHOD THEREFOR

BACKGROUND OF THE INVENTION

1. Field of the Invention

The present invention relates to an image forming system including image forming apparatuses, and a service person support method therefor 2. Description of the Related Art In an electrophotographic image forming apparatus, an electrostatic latent image is formed on an image carrier, and the electrostatic latent image is visualized as a toner image by toner. Then, the toner image is transferred onto a sheet and fixed thereon. Thus, a desired image is formed on the sheet.

The image forming apparatus incorporates various stabilization control devices so as to ensure a stable image forming operation over a long time period in various operational environments or operating conditions. These stabilization control devices control the image forming operation based on values detected by detection means for detecting operating states of the image forming apparatus.

However, the operation of each operating part of the image forming apparatus changes with time, and sometimes the change exceeds a range controllable by an associated one of the stabilization control devices, which makes it impossible to control the operation of the operating part. Further, the aging change or failure of a stabilization control device itself sometimes produces a difference between an actual value and a value detected by the detection means, which makes it impossible to perform proper control, and prevents the image forming apparatus from delivering full performance. In such a case, the image forming apparatus cannot produce excellent images.

When excellent images cannot be obtained, it is necessary to obtain information on a location of a faulty section which has caused the malfunction of the apparatus or a degree of degradation of a component part as a cause of the malfunction. To obtain the information, there has been proposed a method of displaying values detected by detection means provided in the image forming apparatus on the display thereof. Further, there has also been proposed a method of connecting an external measurement device for measuring the operating state of the image forming apparatus to the image forming apparatus e.g. during a periodic inspection performed by a service person, and displaying values measured by the external measurement device.

However, it requires expert knowledge and experience to locate a faulty section which has caused the malfunction or recognize a degree of degradation of a component part as a cause of the malfunction, from values detected or measured by the corresponding method mentioned above. Therefore, it is not easy for a general user to locate the faulty section or recognize the degree of degradation of the component part from the detected values or the measured values.

To overcome this inconvenience, there has been proposed a method of displaying changes of various parameters of image formation so as to enable operating states of the image forming apparatus to be easily grasped, and recording the changes of the parameters in an external device for information sharing (see e.g. Japanese Laid-Open Patent Publication (Kokai) No. H05-053389).

However, check/measurement data obtained by check/measurement performed at the occurrence of a malfunction of the image forming apparatus or during a periodic inspection of the image forming apparatus varies with the operational environment of the image forming apparatus. Therefore, rich experience and expertise are required of a service person so as to carry out accurate and quick replacement or adjustment of a faulty component part at the occurrence of a malfunction or during a periodic inspection. In short, it is difficult for an unskilled service person to carry out accurate and quick replacement or adjustment of a faulty component part at the occurrence of a malfunction or during a periodic inspection, and therefore it sometimes takes a very long time to correct the malfunction or complete the periodic inspection.

SUMMARY OF THE INVENTION

The present invention provides an image forming system including image forming apparatuses, and a service person support method for the image forming system, which enable a service person to accurately and promptly replace or adjust a faulty component part of an image forming apparatus at the occurrence of a malfunction or during a periodic inspection, irrespective of the skill of the service person.

In a first aspect of the present invention, there is provided an image forming system comprising at least one image forming apparatus, a central control unit adapted to manage the image forming apparatus and a storage device, wherein the storage device is adapted to store at least one to-do item that specifies details of operation to be performed by a service person for obtaining data indicative of an operating state of the image forming apparatus, and reference data associated with the to-do item and indicative of a reference operating state corresponding to an operational environment of the image forming apparatus, the central control unit comprising a to-do item-transmitting unit adapted to read out an associated to-do item from the storage device in response to a request input by the service person via the image forming apparatus and transmit the to-do item to the image forming apparatus, a synthetic data-generating unit adapted to read out a reference data associated with the to-do item read out from the storage device, and generate synthetic data of the reference data associated with the to-do item and the data indicative of the operating state of the image forming apparatus obtained from the image forming apparatus by the service person performing the details of operation of the to-do item, and a synthetic data-transmitting unit adapted to transmit the synthetic data generated by the synthetic data-generating unit to the image forming apparatus, and the image forming apparatus comprising a request transmitting unit adapted to receive the request input by the service person and transmit the request input by the service person to the central control unit, a first display unit adapted to display the to-do item received from the central control unit, a data transmitting unit adapted to receive the data indicative of the operating state of the image forming apparatus obtained from the image forming apparatus by the service person performing the details of operation of the to-do item, and transmit the received data to the central control unit, and a second display unit adapted to displays the synthetic data received from the central control unit.

The at least one to-do item stored in the storage device can be adapted to specify the details of operation to be performed by the service person when a malfunction has occurred in the image forming apparatus.

The at least one to-do item stored in the storage device can specify the details of operation to be performed by the service person during a periodic inspection of the image forming apparatus.

The storage device can be externally and communicably connected to the central control unit.

The storage device can be incorporated in the central control unit.

The reference data can be configured to enable the image forming apparatus to perform an excellent image forming operation under the operational environment of the image forming apparatus, and includes a representative value, an upper limit value, and a lower limit value.

The synthetic data can be generated by superimposing the reference data and the data obtained from the image forming apparatus and indicative of the operating state of the image forming apparatus, on a same coordinate system.

The central control unit can be adapted to read out to-do items from the storage device in descending order of priority.

The image forming system can further comprise a transmission unit adapted to transmit a notification of correction of a malfunction, to the central control unit, and the central control unit can be adapted to update priorities of the respective to-do items stored in the storage device in response to receipt of the notification of correction of the malfunction.

In a second aspect of the present invention, there is provided a service person support method for an image forming system including at least one image forming apparatus, a central control unit adapted to manage the image forming apparatus, and a storage device adapted to store at least one to-do item that specifies details of operation to be performed by a service person for obtaining data indicative of an operating state of the image forming apparatus, and reference data associated with the to-do item and indicative of a reference operating state corresponding to an operational environment of the image forming apparatus, comprising the steps of receiving a request input by the service person and transmitting the input request, by the image forming apparatus, reading out an associated to-do item from the storage device in response to the request from the service person, and transmitting the to-do item to the image forming apparatus, by the central control unit, displaying the to-do item received from the central control unit on a display unit, by the image forming apparatus, receiving the data indicative of the operating state of the image forming apparatus obtained from the image forming apparatus by the service person performing the details of operation of the to-do item, and transmitting the received data to the central control unit, by the image forming apparatus, reading out a reference data associated with the to-do item read out from the storage device, and generating synthetic data of the reference data associated with the to-do item and the data indicative of the operating state of the image forming apparatus obtained from the image forming apparatus by the service person performing the details of operation of the to-do item, by the central control unit, transmitting the generated synthetic data to the image forming apparatus, by the central control unit, and displaying the synthetic data received from the central control unit on the display unit, by the image forming apparatus.

According to the present invention, it enables a service person to accurately and promptly replace or adjust a faulty component part of an image forming apparatus at the occurrence of a malfunction or during a periodic inspection, irrespective of the skill of the service person.

The above and other objects, features, and advantages of the invention will become more apparent from the following detailed description taken in conjunction with the accompanying drawings.

DETAILED DESCRIPTION OF THE PREFERRED EMBODIMENTS

The present invention will now be described in detail with reference to the drawings showing a preferred embodiment thereof. It should be noted that the relative arrangement of the components, the numerical expressions and numerical values set forth in the embodiment do not limit the scope of the present invention unless it is specifically stated otherwise.

Figure 1:
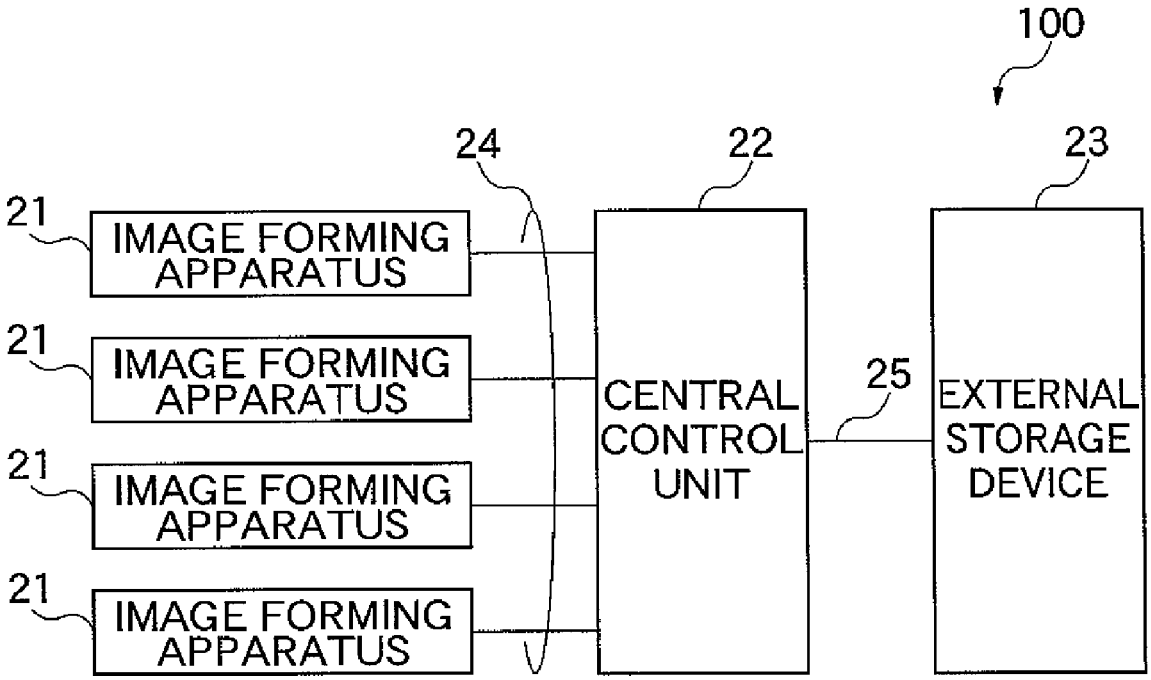
FIG. 1 is a schematic block diagram of an image forming system according to an embodiment of the present invention.

FIG. 1 is a schematic block diagram of an image forming system according to an embodiment of the present invention.

As shown in FIG. 1, the image forming system 100 is comprised of a plurality of image forming apparatuses 21, a central control unit 22 connected to each of the image forming apparatuses 21 via a network 24, and an external storage device 23 connected to the central control unit 22 via a network 25. Although in the present embodiment, the description is given of the external storage device 23 externally and communicably connected to the central control unit 22, by way of example, this is not limitative. For example, the external storage device 23 may be incorporated in the central control unit 22.

Each image forming apparatus 21 is provided with at least a copying function and a communication function. In the present embodiment, it is assumed that the image forming apparatuses 21 are installed in respective different places, and used in respective different operational environments.

The central control unit 22 controls the operating conditions (including the cumulative number of output sheets) of each image forming apparatus 21, and is implemented e.g. by a personal computer or a work station.

The external storage device 23 stores to-do items that a service person should do for each image forming apparatuses 21 at the occurrence of a malfunction or during a periodic inspection thereof, and reference data items associated with the respective to-do items. The to-do items stored in the external storage device 23 indicate items of check/measurement to be performed concerning operating states (sheet conveying timing, transfer voltage, etc.) of the associated image forming apparatus 21. The reference data items are items of data which enable the associated image forming apparatus 21 to perform an excellent image forming operation under its operational environment. The reference data items comprise average values of data obtained when excellent images were formed by other image forming apparatuses 21 on the market which are installed in substantially the same operational environment as that of the image forming apparatus 21.

Each of the networks 24 and 25 is implemented e.g. by a public line network, such as a telephone line, or a local area network (LAN).

Figure 2:
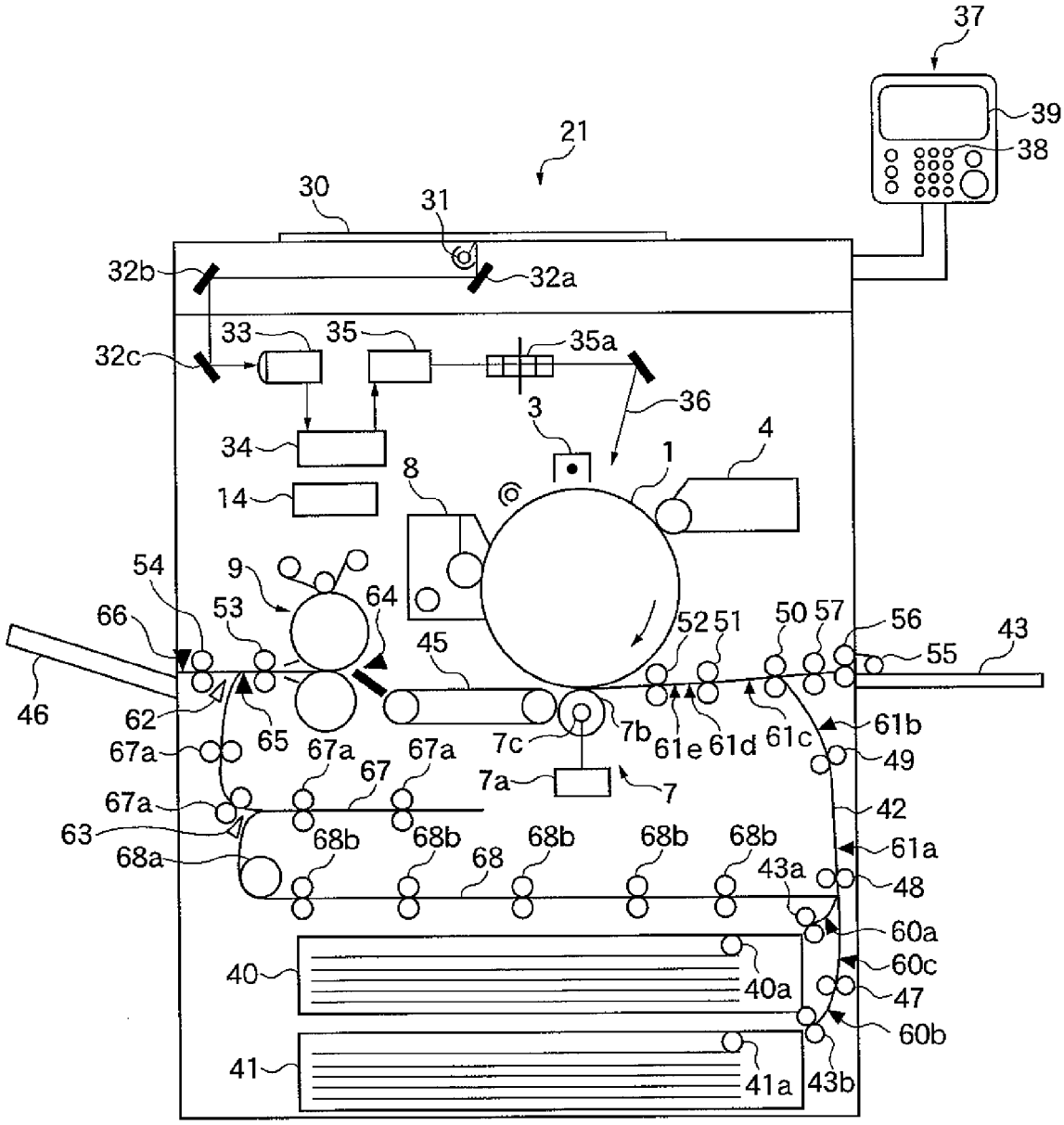
FIG. 2 is a longitudinal cross-sectional view of one of the image forming apparatus appearing in FIG. 1.

Next, the arrangement of the image forming apparatus 21 will be described with reference to FIG. 2. FIG. 2 is a longitudinal cross-sectional view of one of the image forming apparatuses 21 appearing in FIG. 1.

As shown in FIG. 2, the image forming apparatus 21 is provided with a platen glass 30 on which an original is placed. The original placed on the platen glass 30 for copying is irradiated with light from an illuminating lamp 31, and reflected light from the irradiated original is guided by a plurality of mirrors 32*a*, 32*b*, and 32*c* onto a CCD unit 33. The CCD unit 33 converts the reflected light from the original into an electric signal. This electric signal is input to an image processing section 34. The image processing section 34 performs various kinds of processing on the input electric signal to generate a video signal. The generated video signal is input to an exposure section 35.

The exposure section 35 modulates a laser beam based on the input video signal, and the modulated laser beam 36 is irradiated onto a photosensitive drum 1 while being scanned in the main scanning direction by a polygon mirror 35*a*. The photosensitive drum 1 is driven to perform rotation in a direction indicated by an arrow in FIG. 2, and has a surface thereof uniformly charged to a predetermined potential by a primary electrostatic charger 3. When the surface of the photosensitive drum 1 is irradiated with the laser beam 36, an electrostatic latent image is formed on the surface of the photosensitive drum 1.

The electrostatic latent image formed on the surface of the photosensitive drum 1 is visualized as a toner image by toner supplied from a developing device 4. The toner image on the photosensitive drum 1 is transferred onto a sheet fed by a registration roller pair 52 in predetermined timing. This sheet is fed from a sheet feed cassette 40 or 41 via a feed path 42 or from a manual sheet feeder 43.

The transfer roller 7 is comprised of a conductive rotating shaft 7*c* formed e.g. of iron and also serving an electrode, and a conductive rubber layer 7*b* integrally formed on the outer periphery of the rotating shaft 7*c* such that it has a shape of a roller. The transfer roller 7 is urged by a predetermined pressing force against the surface of the photosensitive drum 1. It is preferred that the rubber layer 7*b* is a soft layer having an Asker-C hardness of 50 or below, and the electric resistance between the surface of the rotating shaft 7*c* and that of the rubber layer 7*b* has a value of 107 to 1010Ω when 2 KV is applied. This is to prevent the surface of the photosensitive drum 1 from being damaged and give the rubber layer 7*b* a force for conveying each sheet. Especially, the electric resistance of the rubber layer 7*b* is one of necessary conditions for obtaining excellent transfer images. A predetermined transfer bias is applied to the transfer roller 7 from a transfer high-voltage power supply 7*a*. The toner image on the photosensitive drum 1 is transferred onto the sheet by the action of the applied transfer bias.

The sheet having the toner image transferred thereon is conveyed to a fixing device 9 by a conveying belt 45. Residual toner remaining on the photosensitive drum a after the transfer of the toner image is removed by a cleaner 8. Thus, the photosensitive drum 1 enters a standby state for forming a next electrostatic latent image.

In the fixing device 9, the sheet is heated under pressure, whereby the toner image on the sheet is fixed thereon. After having passed through the fixing device 9, the sheet passes through a conveying roller pair 53, and is conveyed to a discharge roller pair 54 via a switching flapper 62. The sheet conveyed to the discharge roller pair 54 is discharged onto a discharge tray 46 by the discharge roller pair 54.

Further, during double-sided copying, the sheet having passed through the fixing device 9 is guided to an inverting path 67 by the switching flapper 62, and then conveyed into the inverting path 67 by conveying roller pairs 67*a* and temporarily stopped therein. Thereafter, the rotation of each of the conveying roller pairs 67*a* is reversed, whereby the sheet stopped in the inverting path 67 is sent to a re-feeding path 68 via a switching flapper 63. As a result, the sheet is inverted upside down. Then, the sheet is conveyed into the re-feeding path 68 by conveying roller pairs 68*b* and temporarily stopped therein. Thereafter, the sheet is sent to the registration roller pair 52 again via the feed path 42 in predetermined timing.

The above-described sheet conveying system is provided with a plurality of conveying rollers other than those mentioned above and a plurality of sheet detecting sensors. Specifically, the sheet feed cassette 40 is provided with a pickup roller 40*a* for picking up sheets contained therein, one by one, and delivering the same. Further, there is provided a conveying roller pair 43*a* for conveying a sheet sent out from the sheet feed cassette 40 into the feed path 42. At a location downstream of the conveying roller pair 43*a*, there is disposed a sheet detecting sensor 60*a*.

The sheet feed cassette 41 is provided with a pickup roller 41*a* for picking up sheets contained therein, one by one, and delivering the same. Further, there are provided a plurality of conveying roller pairs 43*b* and 47 for conveying a sheet delivered from the sheet feed cassette 41 into the feed path 42. At a location downstream of the conveying roller pair 43*b*, there is disposed a sheet detecting sensor 60*b*, and at a location downstream of the conveying roller pair 47, there is disposed a sheet detecting sensor 60*c*.

In the feed path 42, there are arranged a plurality of conveying roller pairs 48R, 49, 50, and 51 and the registration roller pair 52. There are disposed a sheet detecting sensor 61*a* between the conveying roller pairs 48 and 49, a sheet detecting sensor 61*b* between the conveying roller pairs 49 and 50, a sheet detecting sensor 61*c* between the conveying roller pairs 50 and 51, and a sheet detecting sensor 61*d* between the conveying roller pair 51 and the registration roller pair 52. Further, a sheet detecting sensor 61*e* is disposed in the vicinity of the inlet of the registration roller pair 52.

Sheets stacked on the manual sheet feeder 43 are drawn into the apparatus, one by one, by a pickup roller 55. A sheet drawn into the apparatus is conveyed to the registration roller pair 52 via conveying roller pairs 56, 57, 50 and 51.

A pre-fixation sensor 64 is disposed at the inlet of the fixing device 9, and a sheet detecting sensor 65 in the vicinity of the switching flapper 62. Further, a sheet detecting sensor 66 is disposed at a location downstream of the discharge roller pair 54.

The outputs of respective sensors including the above-mentioned sheet detecting sensors are received by a control section 14, described hereinafter. The control section 14 detects sheet conveying conditions and sheet conveying timing based on the outputs from the respective sensors to thereby drivingly control the respective conveying roller pairs.

Further, the image forming apparatus 21 includes an operating section 37 and the control section 14. The operating section 37 is comprised of various hard keys 38 including ten keys and a start key, and a display 39. The hard keys 38 are used for inputting settings, such as an output size, the number of sheets to be output, and an operation mode, and instructions including an operation start instruction. The display 39 displays the operating states of the image forming apparatus 21 and various kinds of information, such as input information.

The control section 14 controls driving parts such that an image forming operation is carried out according to the settings and instructions input via the operating section 37. The control section 14 is comprised of a CPU (not shown), a memory (not shown), and an input/output interface (not shown). The control section 14 receives the outputs from the respective sensors and outputs control signals to the respective driving parts, via the input/output interface.

When a malfunction has occurred in any of the image forming apparatuses 21 during an image forming operation thereof, a service person is called in to perform an operation for correcting the malfunction. The malfunction during the image forming operation mentioned here is one of malfunctions that cannot be corrected by a user, i.e. any malfunction requiring a service person's operation, such as replacement of a component part needed for execution of an image forming process, or adjustment of parameters set for the component part. Further, a service person's periodic inspection is carried out on each of the image forming apparatuses 21.

Figure 3A:
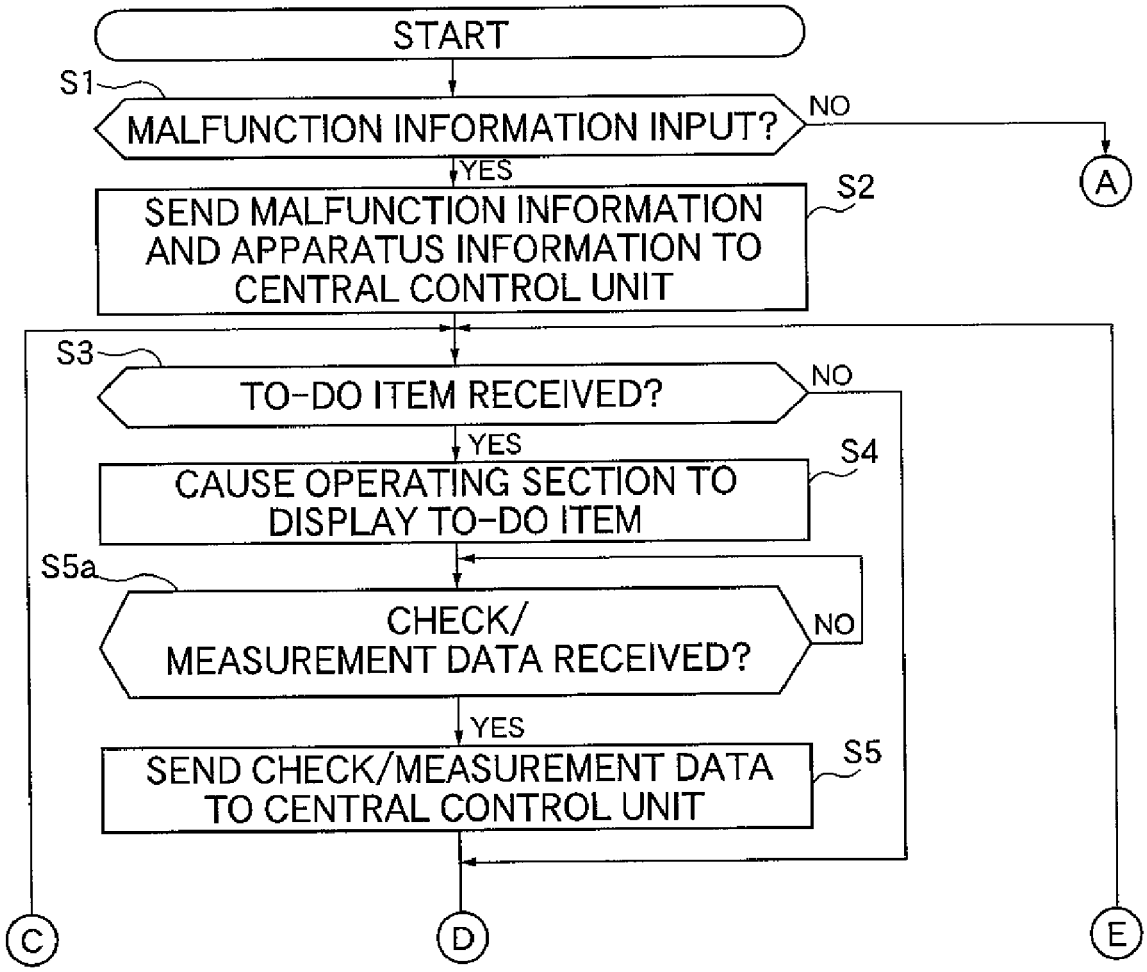
FIGS. 3A and 3B are a flowchart of a process executed by a control section when a malfunction has occurred in the image forming apparatus.
Figure 3B:
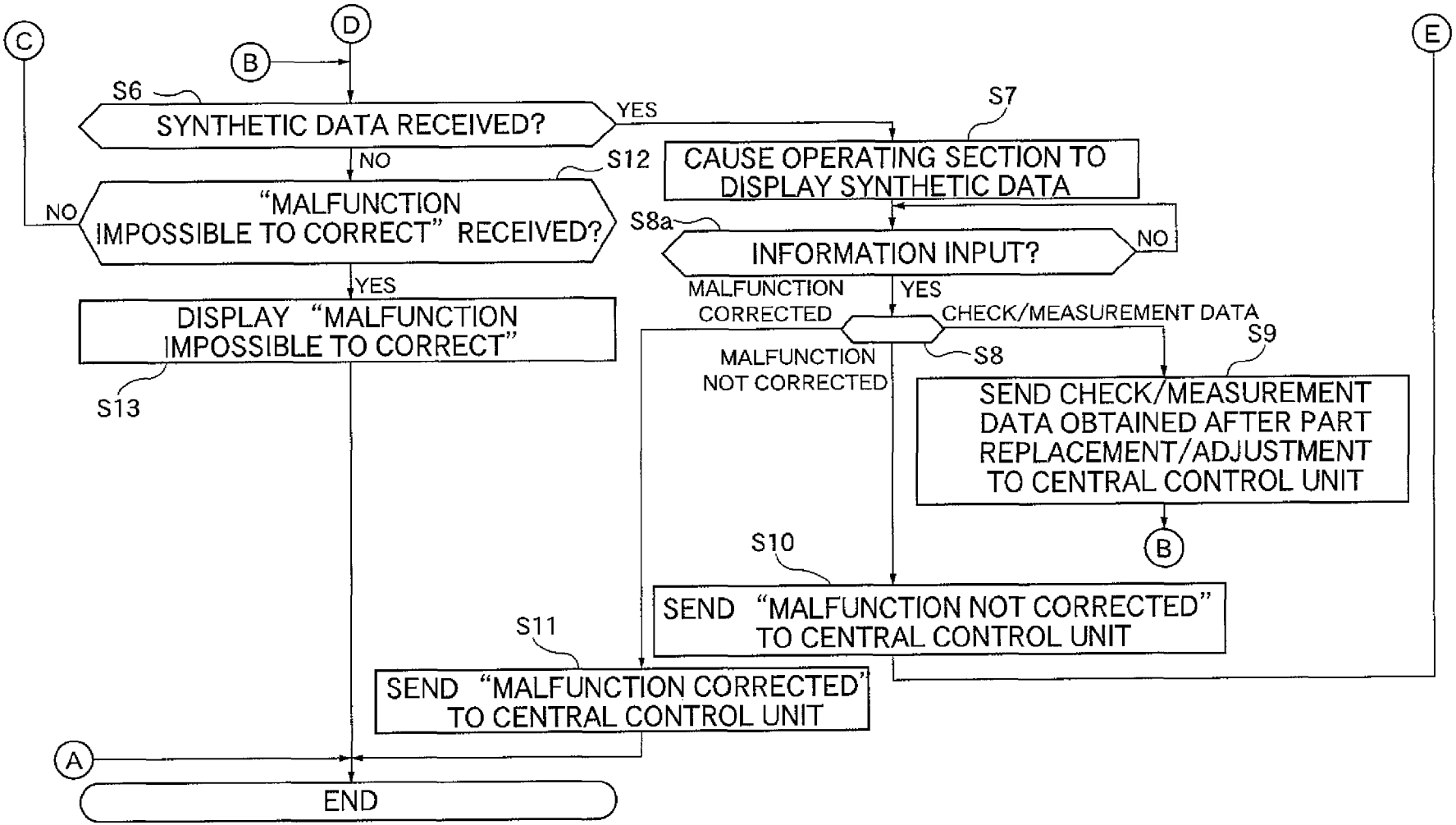

First, with reference to FIGS. 3 and 4, a description will be given of respective processes executed by one of the image forming apparatuses 21 and the central control unit 22, when a malfunction of the above-mentioned kind has occurred in the image forming apparatus 21 during an image forming operation thereof. FIG. 3 is a flowchart of the process executed by the control section 14 when the malfunction has occurred in the image forming apparatus 21, while FIG. 4 is a flowchart of the process executed by the central control unit 22 when the malfunction has occurred in the image forming apparatus 21.

When the malfunction of the above-mentioned kind has occurred in any of the image forming apparatuses 21, a service person is called in. After arriving at a place where the image forming apparatus 21 is installed, the service person inputs malfunction information to the operating section 37 of the image forming apparatus 21. This malfunction information is for identifying an occurrence of the malfunction and details of the malfunction (e.g. image displacement on a sheet, an image blur, etc.).

Referring to FIG. 3, first, when malfunction information is input from the operating section 37 (YES to a step S1), the control section 14 of the image forming apparatus 21 immediately transmits the malfunction information from the operating section 37 to the central control unit 22 via the associated network 24 together with apparatus information (step S2). The apparatus information contains identification information assigned to the image forming apparatus 21, the current cumulative number of output sheets, an operational environment, and the type of sheets in current use.

Figure 4:
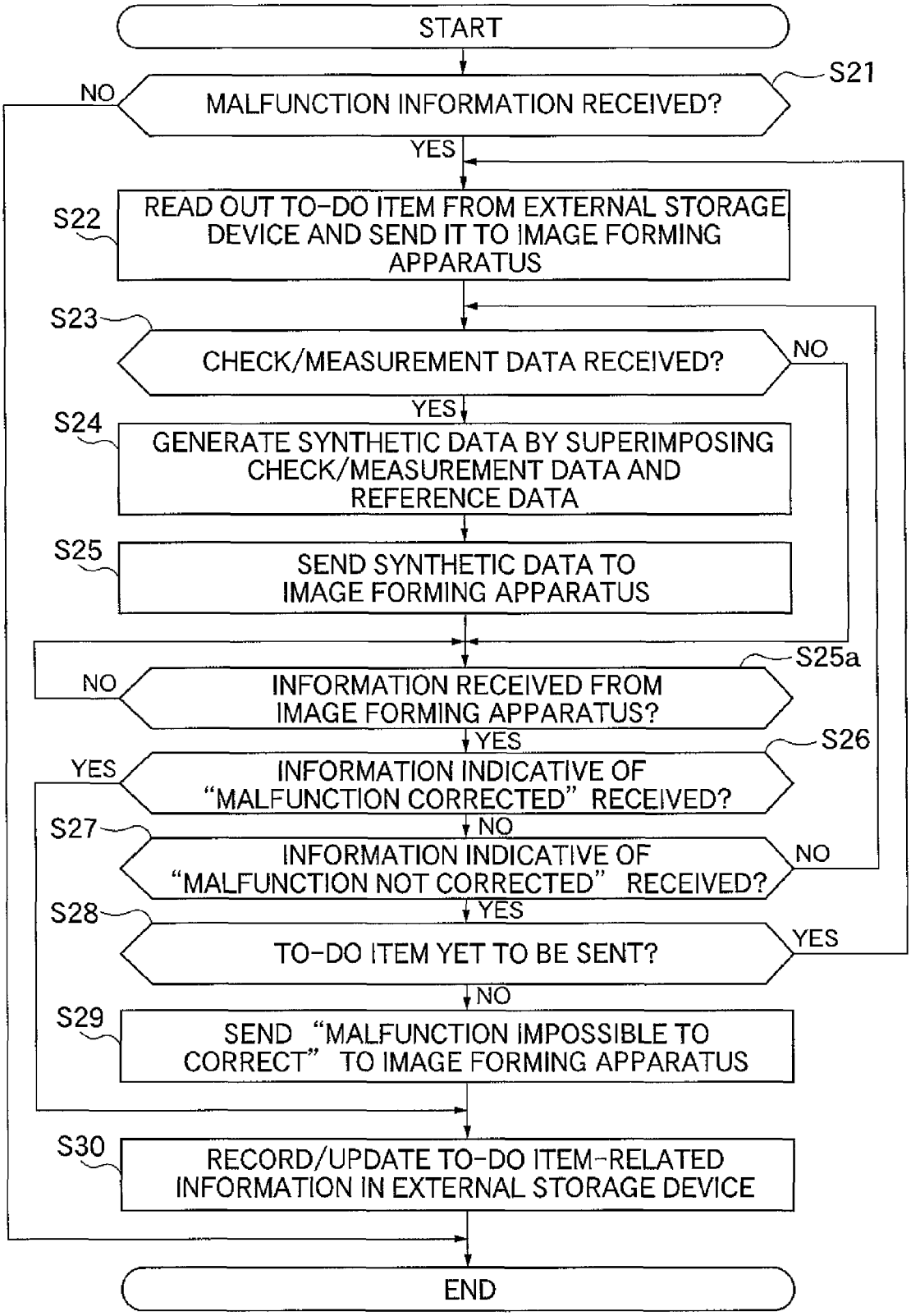
FIG. 4 is a flowchart of a process executed by a central control unit when the malfunction has occurred in the image forming apparatus.

Referring to FIG. 4, upon receipt of the malfunction information and the apparatus information from the image forming apparatus 21 (YES to a step S21), the central control unit 22 reads out an associated to-do item from the external storage device 23 and sends the to-do item to the image forming apparatus 21 from which the malfunction information has been received (step S22). In the step S22, the central control unit 22 identifies the image forming apparatus 21 from which the malfunction information has been received, based on the apparatus information, and identifies the details of the malfunction based on the malfunction information. Then, the to-do item associated with the identified details of the malfunction is read out from the external storage device 23. The to-do item includes a check/measurement item specifying a check/measurement to be performed by the service person so as to correct the identified malfunction, and a method of performing the check/measurement specified by the check/measurement item. In the embodiment, at least one to-do item is read out from the external storage device 23. When a plurality of to-do items are read out, a to-do-item with a top priority is selected and sent to the image forming apparatus 21.

Referring to FIG. 3, upon receipt of the to-do item from the central control unit 22 (YES to a step S3), the control section 14 of the image forming apparatus 21 causes the display 39 of the operating section 37 to display the received to-do item (the check/measurement item and the method of performing the check/measurement specified by the item) (step S4).

The service person carries out a check/measurement operation according to the check/measurement item and the method displayed on the display 39. In this check/measurement operation, an associated jig or a measurement device is used on an as-needed basis. Then, check/measurement data obtained by the check/measurement operation is input to the operating section 37 by the service person. The check/measurement data input here is data of a mark "○" which shows that results of visual inspection by the service person are acceptable (OK), a mark "X" which shows that the results are unacceptable (NOT OK), or data of a numerical value indicative of results of measurement.

Then, upon detecting that the check/measurement data has been input (YES to a step S5*a*), the control section 14 sends the input check/measurement data to the central control unit 22 via the network 24 (step S5).

Referring to FIG. 4, upon receipt of the check/measurement data from the image forming apparatus 21 (YES to a step S23), the central control unit 22 generates synthetic data by superimposing the check/measurement data and a reference data item associated therewith (i.e. associated with the check/measurement item) on the same coordinate system (step S24). The reference data item indicates an allowable range of data for enabling the image forming apparatus to perform an excellent operation and form excellent images under substantially the same operational environment as that of the image forming apparatus 21, and a representative value of the allowable range, and is stored in advance in the external storage device 23 in association with the to-do item. The reference data item is an average of data obtained by other image forming apparatuses 21 on the market which are installed in substantially the same operational environment as that of the image forming apparatus 21 to be corrected the malfunction, or obtained during the process of developing the product (image forming apparatus 21). Next, the central control unit 22 sends the synthetic data to the image forming apparatus 21 via the network 24 (step S25).

Referring to FIG. 3, upon receipt of the synthetic data (YES to a step S6), the control section 14 of the image forming apparatus 21 causes the display 39 of the operating section 37 to display a graph generated based on the received synthetic data (step S7). The graph displayed in the step S7 shows the check/measurement data and the reference data superimposed on the same coordinate system.

The service person can determine one of the following based on the graph of the check/measurement data and the reference data displayed on the display 39:

(1) The check/measurement data indicates "X" or has a value above the upper limit or below the lower limit of the allowable range of the reference data, and the malfunction has not been corrected.

(2) The check/measurement data indicates "○" or has a value within the allowable range, and the malfunction has been corrected.

(3) The check/measurement data indicates "○" or has a value within the allowable range, but the malfunction has not been corrected.

The service person determines a relation between the check/measurement data and the reference data from the graph displayed on the display 39, and when the relation corresponds to the case (1), replaces or adjusts the associated component part based on the to-do item currently displayed on the display 39. After the part replacement or adjustment, the service person performs the check/measurement again, and inputs data obtained from the check/measurement, to the operating section 37.

As a result, as described hereinafter, a graph showing the check/measurement data obtained after the part replacement or adjustment and the reference data in superimposed relation is displayed on the display 39.

IF the graph displayed on the display 39 shows the above-mentioned case (2), the service person inputs information indicative of "malfunction corrected" to the operating section 37. However, if the graph displayed on the display 39 shows the above-mentioned case (3), the service person determines that the malfunction has not been caused by the component part replaced or adjusted this time, and inputs information indicative of "malfunction not corrected" to the operating section 37. As a result, in this case, as described hereinafter, another to-do item is displayed on the display 39. Further, if the graph continues to show the aforementioned case (1) or (3) even after execution of the part replacement or adjustment according to the present to-do item a predetermined number of times, the service person determines that the malfunction is not corrected by the part replacement or adjustment associated with the present item, and in this case as well, inputs "malfunction not corrected" to the operating section 37.

After the synthetic data is displayed on the display 39 in the step S7, if information is input by the service person via the operating section 37 (YES to a step S8*a*), the control section 14 discriminates the kind of the input information (step S8). In the step S8, the control section 14 discriminates which of the check/measurement data after the part replacement or adjustment, the information indicative of "malfunction corrected", and the information indicative of "malfunction not corrected", has been input as the input information. If the input information is the check/measurement data after the part replacement or adjustment, the control section 14 sends the information to the central control unit 22 (step S9). Then, the control section 14 returns to the step S6.

Referring to FIG. 4, upon receipt of the information from the image forming apparatus 21 (YES to a step S25*a*) after transmission of the synthetic data (step S25), the central control unit 22 determines whether or not it is information indicative of "malfunction corrected" (step S26), whether or not it is information indicative of "malfunction not corrected" (step S27), and whether or not the received information is check/measurement data (step S23). If the received information is the check/measurement data (NO to the step S26, NO to the step S27, and YES to the step S23), synthetic data is generated by superimposing the check/measurement data and the reference data item associated therewith (i.e. associated with the check/measurement item) (step S24), and the generated synthetic data is sent to the image forming apparatus 21 via the network 24 (step S25).

In the image forming apparatus 21, when the control section 14 receives the synthetic data after the part replacement or adjustment (YES to the step S6), a graph based on the received synthetic data is displayed on the display 39 (step S7).

The service person checks to determine which of the aforementioned three cases (1) to (3) the displayed graph shows. If it is determined, for example, that the check/measurement data on the graph has changed to indicate "○" or fall within the allowable range of the reference data item and the malfunction has been corrected (the aforementioned case (2)), the service person inputs information indicative of "malfunction corrected" to the control section 14 from the operating section 37. On the other hand, if it is determined that although the check/measurement data on the graph indicates "○" or is within the allowable range of the reference data item, the malfunction has not been corrected (the aforementioned case (3)), or if it is determined the check/measurement data on the graph continues to indicate "X" or be outside the allowable range of the reference data item and the malfunction has not been corrected (the aforementioned case (1)) even after execution of the part replacement or adjustment a predetermined number of times, the service person inputs information indicative of "malfunction not corrected" to the control section 14 to the operating section 37.

If the information input by the service person is indicative of "malfunction not corrected" (step S8), the control section 14 transmits the information indicative of "malfunction not corrected" to the central control unit 22 via the network 24 (step S10). Then, the control section 14 returns to the step S3. On the other hand, if the information input by the service person is indicative of "malfunction corrected" (step S8), the control section 14 transmits the information indicative of "malfunction corrected" to the central control unit 22 via the network 24 (step S11), followed by terminating the present process.

Referring to FIG. 4, if the information has been received from the image forming apparatus 21 (YES to the step S25*a*) and if the information is indicative of "malfunction not corrected" (NO to the step S26; and YES to the step S27), the central control unit 22 determines that the malfunction that has occurred in the image forming apparatus 21 cannot be corrected by the part replacement or adjustment according to the present to-do item. Then, the central control unit 22 determines whether or not there are one or more to-do items remaining to be sent to the image forming apparatus 21 (step S28). If there are one or more to-do items remaining to be sent to the image forming apparatus 21, the central control unit 22 returns to the step S22, wherein a to-do-item with a top priority is selected from those yet to be sent, and is sent to the image forming apparatus 21. On the other hand, if there is no to-do item yet to be sent, the central control unit 22 determines that it is impossible to correct the malfunction that has occurred in the image forming apparatus 21, and sends information indicative of "malfunction impossible to correct" to the image forming apparatus 21 (step S29). Then, the central control unit 22 records to-do item-related information in the external storage device 23 (step S30). The to-do item-related information recorded in the step S30 is indicative of improperness of the reference data items associated with the to-do-items read from the external storage device 23 for correcting the malfunction that has occurred in the image forming apparatus 21, and this information is recorded in the external storage device 23 in association with the to-do items. Further, the check/measurement data after the part replacements and adjustments is also recorded in the external storage device 23 in association with the to-do items. It should be noted that the present process may be configured such that if the graph in the determination of the step S7 in FIG. 3 continues to show the case (1), the service person is enabled to input information of "malfunction impossible to correct", to terminate the process without proceeding to the next to-do-item, and the central processing unit having received the information of "malfunction impossible to correct" proceeds to the step S30 to record the check/measurement data obtained by the part replacement or adjustment associated with in the external storage device 23 in association with the present to-do item.

Referring to FIG. 3, upon receipt of the information indicative of "malfunction impossible to correct" from the central control unit 22 after execution of the step S10 (NO to the step S3, NO to the step S6, and YES to a step S12), the control section 14 of the image forming apparatus 21 causes the display 39 of the operating section 37 to display a message indicative of "malfunction impossible to correct" (step S13), followed by terminating the present process.

Referring to FIG. 4, if information has been received from the image forming apparatus 21 after execution of the step S11 in FIG. 3 (YES to the step S25*a*), and if the received information is indicative of "malfunction corrected", the central control unit 22 updates to-do item-related information in the external storage device 23 (step S30). The to-do item-related information updated in this case is the priorities of to-do items, and is updated such that the priority of the to-do item used at the time of determination by the service person that the malfunction has been corrected becomes higher than the priorities of the other to-do items. Further, the present check/measurement data after the part replacement or adjustment is also recorded in the external storage device 23 in association with the to-do item.

Let it be assumed that the service person has checked to determine that check/measurement data obtained e.g. according to an initial to-do item indicates "X" or has a value above the upper limit of the allowable range of the reference data or below the lower limit of the allowable range. In this case, the service person replaces or adjusts a component part associated with the to-do item, and then inputs check/measurement data obtained after the part replacement or adjustment from the operating section 37. As a result, a graph showing the check/measurement data and the associated reference data item in superimposed relation is displayed on the display 39.

In this case, when the graph is changed such that the check/measurement data obtained after the part replacement or adjustment falls within the allowable range of the reference data associated with the check/measurement data, the service person determines that the malfunction has been corrected, and inputs information indicative of "malfunction corrected" to the operating section 37. Upon execution of the input, the central control unit 22 is notified that the malfunction has been corrected. The central control unit 22 increases the priority for the to-do-item associated with the replaced or adjusted component part, according to the notification. More specifically, the central control unit 22 updates the priority of the associated to-do item in the external storage device 23. Further, the check/measurement data obtained after the part replacement or adjustment which contributed to correction of the malfunction is recorded in the external storage device 23 in association with the to-do item.

When check/measurement data obtained according to the to-do-item currently displayed on the display 39 before part replacement or adjustment is within the allowable range of a reference data item associated therewith, the service person determines that the malfunction has not been caused by a component part associated with the to-do item. In this case, another to-do-item with the next priority is presented according to the process executed by the control section 14.

Thus, the check/measurement is carried out for each of to-do items until check/measurement data obtained after the replacement or adjustment of a component part associated with the to-do-item falls within the allowable range of the associated reference data item and the present malfunction is corrected.

As described above, when a malfunction occurs in the image forming apparatus 21, operations for correcting a malfunction are performed while taking into account the operational environment and operating conditions of the image forming apparatus 21, so that even an unskilled service person can promptly and reliably carry out the correction of the malfunction.

However, even if the replacement/adjustment of each associated component part is performed according to each of all to-do items, it sometimes occurs that the malfunction cannot be corrected when the allowable range of a reference data item is not set properly, or when the cause of a malfunction is exceptional. In such a case, extensive disassembly and repair for identifying and correcting a malfunction are required, and it is necessary to change to-do-items associated with the identified malfunction or reference data (allowable range and representative value) associated with each relevant to-do item. When the to-do items or the reference data are to be changed, the operational environment of the image forming apparatus 21 is identified again, and reference data for enabling the image forming apparatus 21 to form excellent images under the operational environment is determined. Then, the reference data stored in the external storage device 23 is updated to the obtained reference data.

Figure 5:
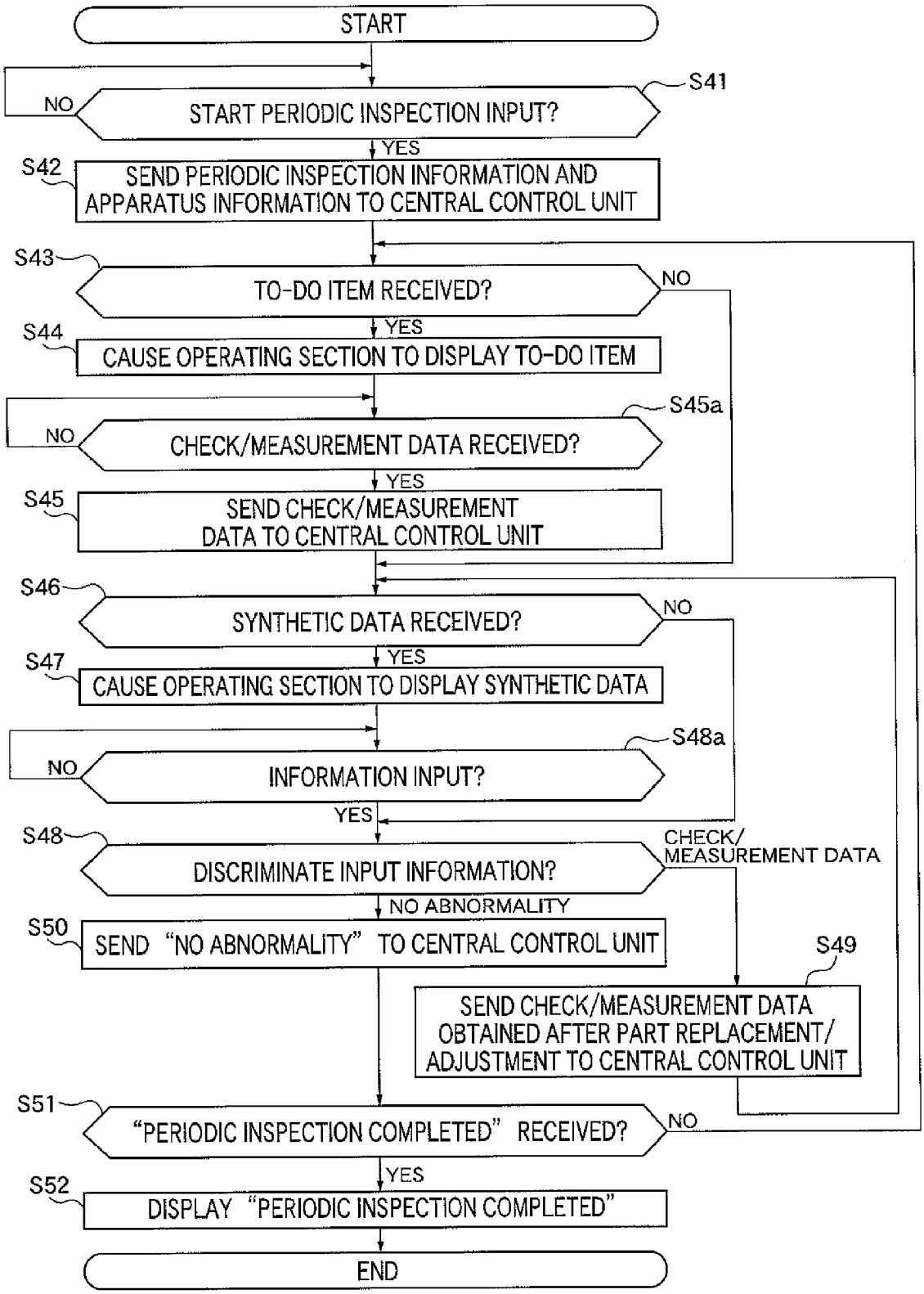
FIG. 5 is a flowchart of a process executed by the image forming apparatus during a periodic inspection of the same.

Next, with reference to FIGS. 5 and 6, a description will be given of respective processes executed by the image forming apparatus 21 and the central control unit 22, when a periodic inspection is performed on the image forming apparatus 21. FIG. 5 is a flowchart of the process executed by the control section 14 of the image forming apparatus 21 during the periodic inspection of the same, while FIG. 6 is a flowchart of the process executed by the central control unit 22 during the periodic inspection of the image forming apparatus 21.

The control section 14 of the image forming apparatus 21 monitors input of information indicative of "start periodic inspection", via the operating section 37, by a service person in charge of the periodic inspection. This information indicative of "start periodic inspection" is input together with periodic inspection information (a periodic inspection name, periodic inspection date and time, a periodic inspection site, etc.).

Referring to FIG. 5, when the information indicative of "start periodic inspection" is input (YES to a step S41), the control section 14 sends a periodic inspection start instruction, the input periodic inspection information, and apparatus information to the central control unit 22 via the network 24 (step S42). The apparatus information contains the identification information of an image forming apparatus, the current cumulative number of output sheets, the operational environment of the image forming apparatus 21, the type of sheets in current use, etc.

Figure 6:
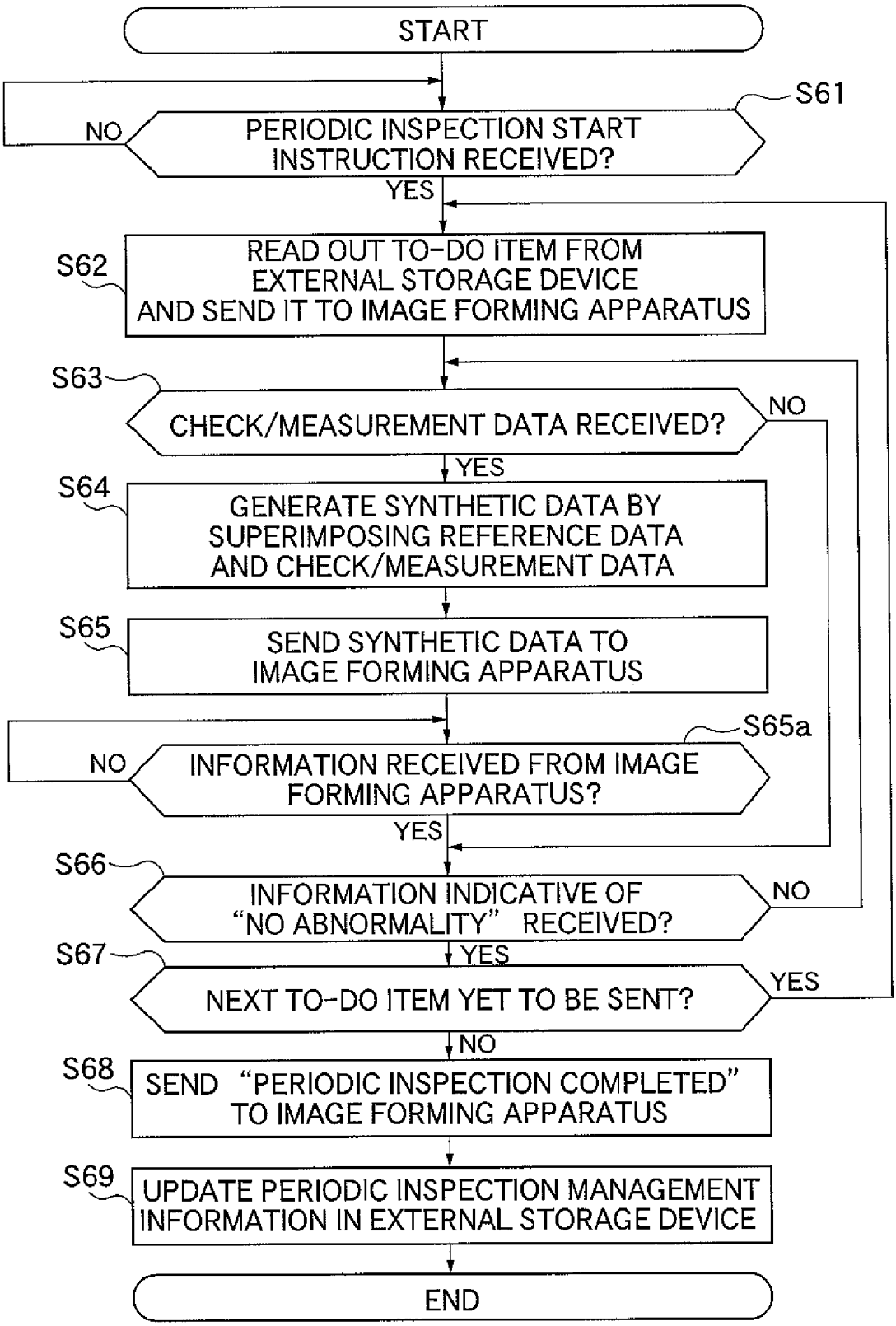
FIG. 6 is a flowchart of a process executed by the central control unit during the periodic inspection of the image forming apparatus.

Referring to FIG. 6, upon receipt of the periodic inspection start instruction from the image forming apparatus 21 (YES to a step S61), the central control unit 22 reads out a to-do-item associated with the apparatus information from the external storage device 23 and sends the to-do item to the image forming apparatus 21 (step S62). The to-do item includes specifying a check/measurement to be performed by the service person for periodic inspection and a method of performing the check/measurement specified by the check/measurement item. In this step, at least one to-do item is read out from the external storage device 23. When a plurality of to-do items are read out, a to-do-item with a top priority is selected and sent to the image forming apparatus 21.

Referring to FIG. 5, upon receipt of the to-do item from the central control unit 22 (YES to a step S43), the control section 14 of the image forming apparatus 21 causes the display 39 of the operating section 37 to display the received to-do item (the check/measurement item and the method of performing the check/measurement specified by the item) (step S44).

The service person carries out check/measurement operation according to the check/measurement item and the method displayed on the display 39, and inputs check/measurement data obtained by the check/measurement operation to the operating section 37. The check/measurement data input here is data of a mark "○" which shows that results of visual inspection by the service person are acceptable (OK) or a mark "X" which shows that the results are unacceptable (NOT OK), or data of a numerical value indicative of results of measurement.

Upon detecting that the check/measurement data has been input (YES to a step S45*a*), the control section 14 sends the input check/measurement data to the central control unit 22 via the network 24 (step S45).

Referring to FIG. 6, upon receipt of the check/measurement data from the image forming apparatus 21 (YES to a step S63), the central control unit 22 generates synthetic data by superimposing the check/measurement data and a reference data item associated therewith on the same coordinate system (step S64). The reference data item is stored in advance in the external storage device 23 in association with the to-do item. Then, the central control unit 22 sends the synthetic data to the image forming apparatus 21 via the network 24 (step S65).

Referring to FIG. 5, upon receipt of the synthetic data (YES to a step S46), the control section 14 of the image forming apparatus 21 causes the display 39 of the operating section 37 to display a graph generated based on the received synthetic data (step S47). The graph displayed in the step S47 shows the check/measurement data and the reference data on the same coordinate system in superimposed relation.

The service person checks to determine whether or not the check/measurement data on the displayed graph has "no abnormality". If the initial check/measurement data indicates "○" or is within the allowable range of the reference data, it is possible to determine that the check/measurement data has "no abnormality". In this case, the service person inputs information indicative of "no abnormality" via the operating section 37.

On the other hand, if the initial check/measurement data on the displayed graph indicates "X" or is not within the allowable range of the reference data, replacement or adjustment of a component part associated with the present to-do item is performed. After execution of the part replacement or adjustment, the check/measurement is performed again, and a check/measurement data obtained by the check/measurement is input from the operating section 37. As a result, a graph is displayed again on the display 39, and the service person checks to determine whether or not the check/measurement data on the graph has no abnormality. Thus, replacement or adjustment of a component part associated with a displayed to-do item is repeatedly carried out until check/measurement data indicates "○" or falls within the allowable range of the reference data.

When information is input by the service person via the operating section 37 (YES to a step S48*a*) after display of the synthetic data on the display 39 in the step S47, and if the input information is check/measurement data after part replacement or adjustment (step S48), the control section 14 sends the input check/measurement data to the central control unit 22 via the network 24 (step S49). Then, the control section 14 returns to the step S46.

Referring to FIG. 6, if information is received from the image forming apparatus 21 (YES to a step S65*a*) after transmission of the synthetic data (step S65) and the received information is check/measurement data obtained after the part replacement or adjustment (NO to a step S66 and YES to the step S63), synthetic data is generated by superimposing the check/measurement data and the associated reference data item (step S64), and the generated synthetic data is sent to the image forming apparatus 21 via the network 24 (step S65).

In the image forming apparatus 21, when the control section 14 receives the synthetic data generated after the part replacement or adjustment (YES to the step S46), a graph based on the received synthetic data is displayed on the display 39 (step S47).

On the other hand, if the information input by the service person is indicative of "no abnormality" (step S48), the control section 14 sends the information to the central control unit 22 (step S50).

Referring to FIG. 6, if the information is received (YES to the step S65*a*) and the information is indicative of "no abnormality" (YES to the step S66), the central control unit 22 determines whether or not there are one or more to-do items remaining to be sent to the image forming apparatus 21 (step S67). If there are one or more to-do items yet to be sent to the image forming apparatus 21, the central control unit 22 returns to the step S62, wherein a to-do-item with a top priority is selected from those yet to be sent, and is sent to the image forming apparatus 21. On the other hand, if there is no to-do item yet to be sent, the central control unit 22 sends information indicative of "periodic inspection completed" to the image forming apparatus 21 (step S68). Then, the central control unit 22 records check/measurement data items obtained on a to-do-item-by-to-do item basis in the external storage device 23, and updates periodic inspection management information stored in the external storage device 23 (step S69), followed by terminating the present process.

Referring to FIG. 5, if a next to-do item is received after execution of the step S50 (NO to a step S51 and YES to the step S43), the control section 14 of the image forming apparatus 21 continues to execute the steps S44 et seq. On the other hand, if "periodic inspection completed" is received (YES to the step S51), the control section 14 causes the display 39 of the operating section 37 to display a message indicative of "periodic inspection completed" (step S52), followed by terminating the present process.

Figure 7:
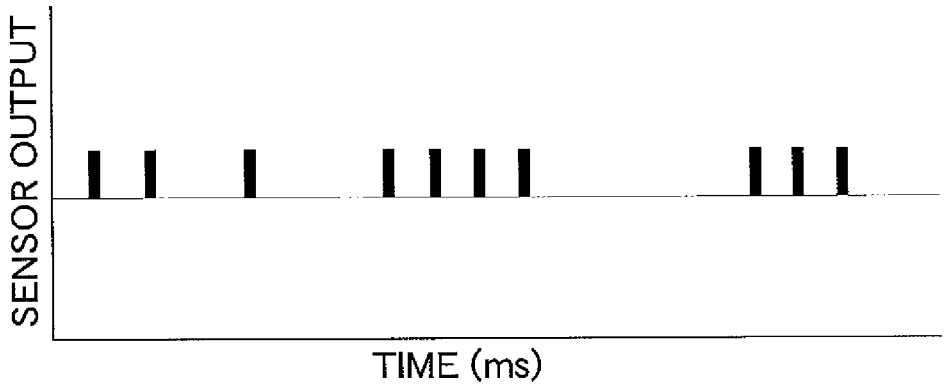
FIG. 7 is a timing diagram of an example of measurement of sheet conveying timings.
Figure 8A:
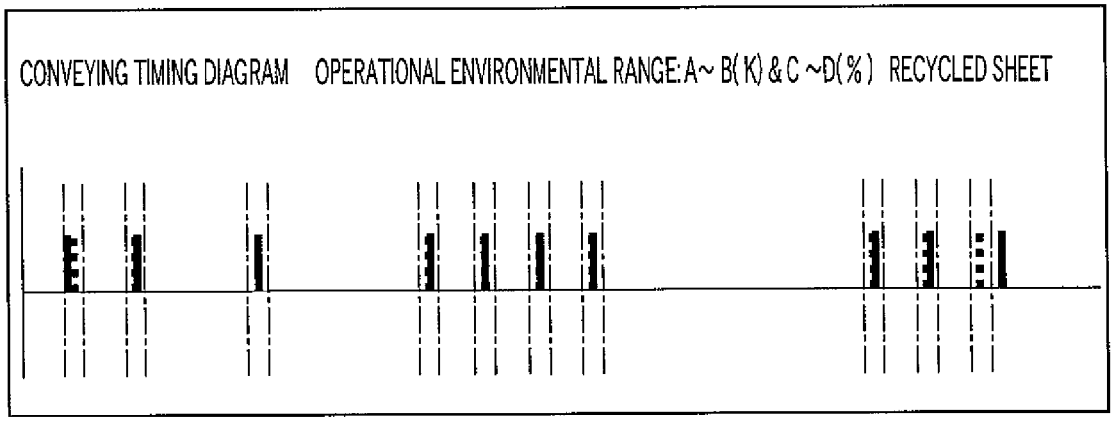
FIGS. 8A and 8B are respective examples of display of a timing diagram showing the sheet conveying timings in FIG. 7 and reference timings in superimposed relation.
Figure 8B:
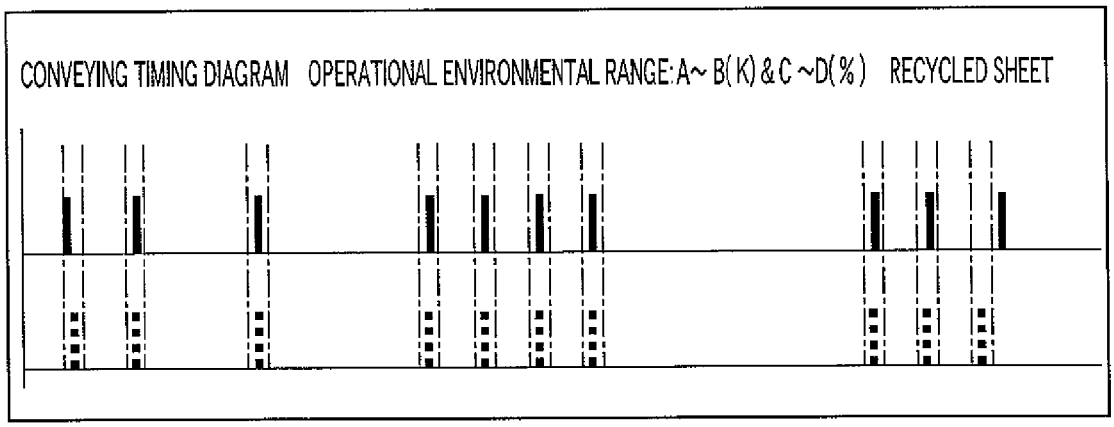

Next, with reference to FIG. 7 and FIGS. 8A and 8B, a description will be given of a case where measurement of sheet conveying timings is performed as a to-do-item at the occurrence of a malfunction or during a periodic inspection. FIG. 7 is a timing diagram of an example of measurement of sheet conveying timings. FIG. 8A is an example of display of a timing diagram showing the sheet conveying timings in FIG. 7 and reference timings in superimposed relation, and FIG. 8B is another example of display of the timing diagram showing the sheet conveying timings in FIG. 7 and the reference timings in superimposed relation.

The sheet conveying timings change during one job in a time-dependent manner, and hence it is important data for identifying a cause of occurrence of jamming or image displacement. The sheet conveying timings can be measured by monitoring driving inputs to the respective conveying rollers and the like, outputs from the respective sensors on the respective conveying path, and so forth.

Upon receipt of the to-do item of measuring sheet conveying timings, the image forming apparatus 21 displays the to-do item on the display 39. The service person connects a measurement device or the like to the image forming apparatus 21, and measures associated data according to the displayed to-do item. More specifically, the driving inputs to the respective conveying rollers and the like, the outputs from the respective sensors on the respective conveying path, and so forth are monitored, whereby the sheet conveying timings are measured. From results of this measurement, it is possible to obtain a timing diagram in one job, as shown in FIG. 7 by way of example. In the timing diagram shown in FIG. 7, timings at which there occurred respective changes in the outputs of the sensors on the conveying paths in one job are arranged in a time-series fashion from a time point at which driving input to the pickup roller 40*a* (41*a*) of the cassette 40 (41) was performed. The data indicative of results of the measurement is sent from the image forming apparatus 21 to the central control unit 22. The illustrated example shows sheet conveying timings (output timings of the sensors 60*b*, 60*c*, 61*a* to 61*e*, 64, 65, and 66) in a single-sided image forming mode, which were measured during a time period from a time point when a sheet was picked up from the cassette 41 to a time point when the sheet reached the discharge tray 46.

The central control unit 22 reads out reference data of sheet conveying timings associated with the image forming apparatus 21 from the external storage device 23. The reference data read out from the external storage device 23 is superimposed on the measurement results received from the image forming apparatus 21 on the same coordinate system, whereby synthetic data is generated. The generated synthetic data is sent to the image forming apparatus 21.

Upon receipt of the synthetic data, the image forming apparatus 21 displays the same on the display 39. This synthetic data represents e.g. the conveying timing diagram shown in FIG. 8A. This conveying timing diagram shows timings measured at the respective occurrences of changes in the outputs of the sensors during one job, respective allowable ranges of corresponding reference timings and representative timings thereof, which are arranged in time series from the time point of driving input to the pickup roller of the cassette. In the present conveying timing diagram, each bold solid line indicates a timing when a change in the output of the associated sensor was measured. On the other hand, each dotted line indicates a representative timing the corresponding reference timing. The representative timing is an average timing obtained from other image forming apparatuses 21 on the market which are installed in substantially the same operational environment as that of the image forming apparatus 21. Each representative timings in the illustrated example was obtained under an operational environment with an operational temperature range of A to B K (Kelvin) and an operational humidity range of C to D %. Further, periods between respective pairs of one-dot chain lines indicate allowable ranges of the reference timings for enabling the image forming apparatus 21 to perform an excellent operation and form excellent images.

Further, it is possible to selectively switch a display mode of the synthetic data in response to an input operation from the operating section 37. For example, the conveying timing diagram shown in FIG. 8A can be switched to the conveying timing diagram shown in FIG. 8B.

The service person can check and determine, based on the displayed timing diagram, whether or not each of the detected current conveying timings differs from a representative timing of the corresponding reference timing and lies within a corresponding allowable range of the reference timing. Then, the service person takes an action according to the result of the check. For example, it is known from the conveying timing diagram shown in FIG. 8A that a current conveying timing in one position on the conveying path differs from a representative timing of the corresponding reference timing and is not within a corresponding allowable range of the reference timing. Therefore, by adjusting timings for driving respective conveying roller pairs for conveying each sheet so as to shift the position of the conveying timing to the position of the reference timing, it is possible to reduce the difference of sheet conveying timing from the correspondence respective timing such that it is within the allowable range of the reference timing. As a consequence, paper jam and image displacement on each sheet due to the difference in sheet conveying timing can be corrected.

As described above, according to the present embodiment, it is possible to easily identify a component part as a cause of a malfunction, and replace or adjust the component part. This makes it no longer necessary for a skilled service person to guess the cause of a malfunction and actually carry out numerous image forming operations for reproduction and verification of the malfunction, on site.

Further, since reference timings to be compared with e.g. the current sheet conveying timings in the image forming apparatus 21 are associated with the operational environment of the image forming apparatus 21, it is possible to accurately grasp the cause of a malfunction without the experience and expertise of skilled engineers.

Figure 9:
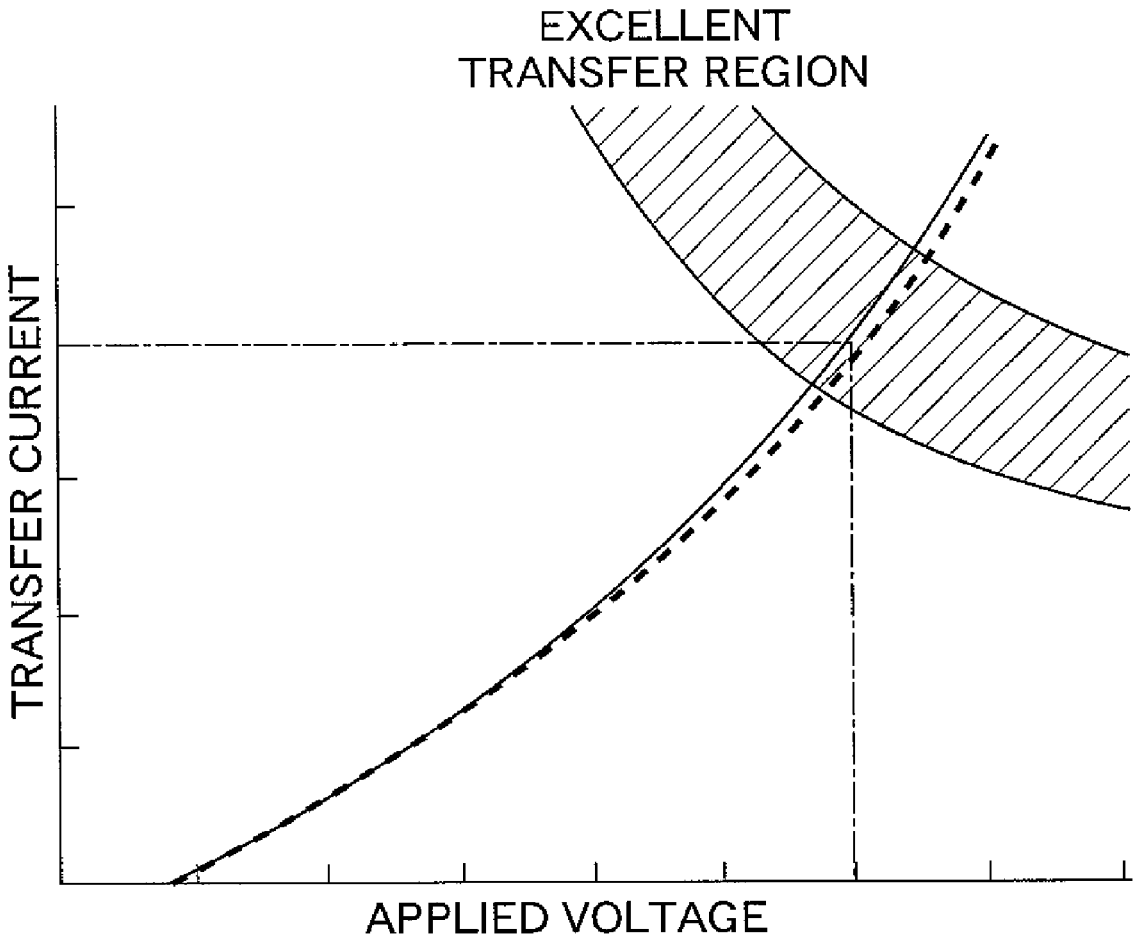
FIG. 9 is a transfer current-voltage characteristic diagram showing the relationship between the value of a transfer current flowing through a transfer roller of the image forming apparatus and a transfer bias applied to the transfer roller.
Figure 10:
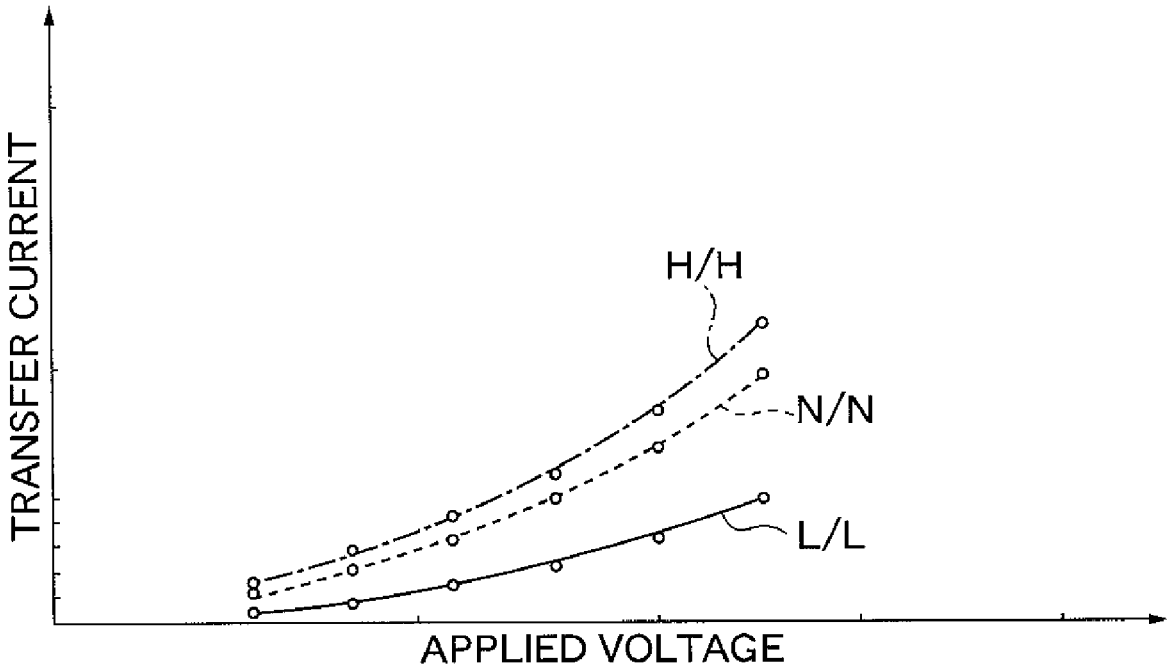
FIG. 10 is a transfer current-voltage characteristic diagram showing the relationship between the value of the transfer current flowing through the transfer roller and the transfer bias applied to the transfer roller, depicted using a humidity environment thereof as a parameter.

Next, with reference to FIGS. 9 and 10, a description will be given of a case where transfer current of the transfer roller 7 and transfer bias applied to the same are measured as a to-do-item at the occurrence of a malfunction or during a periodic inspection. FIG. 9 is a transfer current-voltage characteristic diagram showing the relationship between the value of a transfer current flowing through the transfer roller 7 of the image forming apparatus 21 and a transfer bias applied to the transfer roller 7. FIG. 10 is a transfer current-voltage characteristic diagram showing the relationship between the value of the transfer current flowing through the transfer roller 7 and the transfer bias applied to the transfer roller 7, depicted using the humidity environment thereof as a parameter.

In order to determine the relationship between the transfer current of the transfer roller 7 and the transfer bias applied to the transfer roller 7, bias voltage applied to the transfer roller 7 is varied, and transfer current values corresponding to respective bias voltage values are measured. As a method of measuring the transfer current, it is known to change a control value of bias voltage e.g. using hard keys of the operating section 37, and measure a transfer current value when a bias voltage corresponding to the control value is applied, by a detection means provided in the image forming apparatus 21. In this case, the measured transfer current value is temporarily stored in the memory in the image forming apparatus 21.

Further, there is also proposed a method of directly connecting a measurement device to predetermined terminals or predetermined portions of the image forming apparatus 21, and measuring the transfer current by the measurement device. In this case, a measured transfer current value is input e.g. using hard keys of the operating section 37. Alternatively, the measured transfer current value may be transferred from the measurement device to the image forming apparatus 21, using a network.

When sampling of transfer current values and bias voltage values is completely carried out by one of the above-mentioned methods, the sampled data is sent as current-voltage characteristic data to the central control unit 22. The central control unit 22 reads out average transfer current-voltage characteristic data indicative of the average relationship between the transfer current and the bias voltage, which was obtained from other image forming apparatuses 21 that are on the market and are installed in substantially the same environment and use conditions as the image forming apparatus 21, from the external storage device 23, as reference data. Then, synthetic data is generated by superimposed the average transfer current-voltage characteristic data and the current-voltage characteristic data from the image forming apparatus 21 on the same coordinate system. This synthetic data is sent to the image forming apparatus 21.

Upon receipt of the synthetic data, the image forming apparatus 21 displays on the display 39 a graph formed based on the synthetic data, which illustrates the transfer current-voltage characteristic based on the resistance value of the transfer roller 7, as shown in FIG. 9. In this graph, a solid line indicates a transfer current-voltage characteristic curve showing the relationship between the transfer current and the bias voltage measured this time. A dotted line indicates an average transfer current-voltage characteristic curve showing the average relationship between the transfer current and the bias voltage, which was obtained from other image forming apparatuses 21 that are on the market and are installed in substantially the same environment and use conditions as the image forming apparatus 21. A hatched area indicates an excellent transfer region where the image forming apparatus can perform an excellent operation and form excellent images. Further, one-dot chain lines indicate respective setting values of the current configuration of the image forming apparatus 21.

Referring to FIG. 10, the electric resistance of the transfer roller 7 is susceptible to the operational environment, and particularly to humidity. The electric resistance becomes larger under a low-humidity environment, and smaller under a high-humidity environment. Specifically, under a low-temperature and low-humidity environment (L/L environment), the electric resistance of the transfer roller 7 assumes a value several orders of magnitude larger than a value assumed under a normal-temperature and normal-humidity environment (N/N environment), whereas under a high-temperature and high-humidity environment (H/H environment), the electric resistance of the transfer roller 7 assumes a value one or two orders of magnitude smaller than the value assumed under the normal-temperature and normal-humidity environment (N/N environment). Further, the resistance value of the transfer roller 7 varies with the durability of the transfer roller 7. Furthermore, configurations (including transfer current settings) suitable for obtaining excellent transfer images are different depending on the material of sheets in use, etc.

In the present embodiment, however, it is possible to perform a comparison between the transfer current-voltage characteristic indicative of the relationship between measured transfer current and measured bias voltage, and the average transfer current-voltage characteristic or allowable range thereof determined while taking into account the operational environment (particularly, temperature and humidity) of the image forming apparatus 21, the material of sheets, and so forth. This makes it possible to accurately determine, without the experience and expertise of skilled engineers, whether or not the current transfer current-voltage characteristic of the image forming apparatus 21 is appropriate.

Although in the present embodiment, the description is given of the case of measuring the sheet conveying timings that change during a job in a time-dependent manner, the object to be measured is not limited to this. The objects to be measured include timings associated with the voltage value and current value of a device operated for a job, such as the primary electrostatic charger 3 or the developing device 4, and the time-varying temperatures of the fixing roller 9 and a pressure roller of the fixing device 9. The objects to be measured also include the potential, density, and driving torque of the photosensitive drum 1, which varies over a long time according to the cumulative number of output sheets.

Although in the present embodiment, the description is given of measurement of the transfer current-voltage characteristic of the transfer roller 7, which changes according to a change in the resistance value of the transfer roller 7, by way of example, this is not limitative. For example, the sensitivity of the photosensitive drum 1 or toner density, which changes in accordance with a change in the physical property value of a component part or the like controlled based on the control value of the transfer high-voltage power supply 7*a*, may be measured.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Applications No. 2006-098773, filed Mar. 31, 2006, which is hereby incorporated by reference herein in its entirety.

What is claimed is:

1. An image forming system comprising:

at least one image forming apparatus;

a central control unit adapted to manage said image forming apparatus; and a storage device, wherein said storage device is adapted to store at least one to-do item that specifies details of an operation to be performed by a service person for obtaining operating data indicative of an operating state of said image forming apparatus, and reference data associated with the to-do item and indicative of a reference operating state corresponding to an operational environment of said image forming apparatus and a type of a sheet, said central control unit comprising a to-do item-transmitting unit adapted to read out an associated to-do item corresponding to the operational environment of said image forming apparatus and the type of the sheet from said storage device in response to a request input by the service person via said image forming apparatus and transmit the to-do item to said image forming apparatus, a synthetic data-generating unit adapted to read out a reference data associated with the to-do item from said storage device, and generate synthetic data of the reference data associated with the to-do item and the operating data indicative of the operating state of said image forming apparatus obtained from said image forming apparatus by the service person performing the details of an operation of the to-do item, and a synthetic data-transmitting unit adapted to transmit the synthetic data generated by said synthetic data-generating unit to said image forming apparatus, and said image forming apparatus comprising a request transmitting unit adapted to receive the request input by the service person and transmit the request input by the service person and information related to the operational environment of said image forming apparatus and the type of the sheet to said central control unit, a display unit adapted to display the to-do item received from said central control unit, a data transmitting unit adapted to receive the data indicative of the operating state of said image forming apparatus obtained from said image forming apparatus by the service person performing the details of the operation of the to-do item, and transmit the received data to said central control unit, wherein the display unit is adapted to display the synthetic data received from said central control unit, wherein the reference data indicates an allowable range of timing when the sheet reaches a predetermined position of said image forming apparatus, wherein the operating data indicates an actual timing when the sheet reaches the predetermined position of said image forming apparatus, and wherein the synthetic data is data superimposing the reference data and the operating data on the same coordinate system.

2. The image forming system according to claim 1, wherein the at least one to-do item stored in said storage device is adapted to specify the details of an operation to be performed by the service person when a malfunction has occurred in said image forming apparatus.

3. The image forming system according to claim 1, wherein the at least one to-do item stored in said storage device specifies the details of an operation to be performed by the service person during a periodic inspection of said image forming apparatus.

4. The image forming system according to claim 1, wherein said storage device is externally and communicably connected to said central control unit.

5. The image forming system according to claim 1, wherein said storage device is incorporated in said central control unit.

6. The image forming system according to claim 1, wherein the reference data enables said image forming apparatus to perform an image forming operation under the operational environment of said image forming apparatus, and includes a representative value, an upper limit value, and a lower limit value.

7. The image forming system according to claim 1, wherein said central control unit is adapted to read out to-do items from said storage device in descending order of priority.

8. The image forming system according to claim 1, further comprising a transmission unit adapted to transmit a notification of correction of a malfunction, to said central control unit, and wherein said central control unit is adapted to update priorities of the respective to-do items stored in said storage device in response to receipt of the notification of correction of the malfunction.

9. A service person support method for an image forming system including at least one image forming apparatus, a central control unit adapted to manage the image forming apparatus, and a storage device adapted to store at least one to-do item that specifies details of an operation to be performed by a service person for obtaining operating data indicative of an operating state of the image forming apparatus, and reference data associated with the to-do item and indicative of a reference operating state corresponding to an operational environment of the image forming apparatus and a type of a sheet, comprising the steps of:

receiving a request input by the service person and transmitting the input request and information related to the operational environment of said image forming apparatus and the type of the sheet to the central control unit, by the image forming apparatus;

reading out an associated to-do item corresponding to the operational environment of said image forming apparatus and the type of the sheet from the storage device in response to the request from the service person, and transmitting the to-do item to the image forming apparatus, by the central control unit;

displaying the to-do item received from the central control unit on a display unit, by the image forming apparatus;

receiving the operating data indicative of the operating state of the image forming apparatus obtained from the image forming apparatus by the service person performing the details of an operation of the to-do item, and transmitting the received data to the central control unit, by the image forming apparatus;

reading out a reference data associated with the to-do item from said storage device, and generating synthetic data of the reference data associated with the to-do item and the operating data indicative of the operating state of the image forming apparatus obtained from the image forming apparatus by the service person performing the details of the operation of the to-do item, by the central control unit;

transmitting the generated synthetic data to the image forming apparatus, by the central control unit; and displaying the synthetic data received from the central control unit on the display unit, by the image forming apparatus, wherein the reference data indicates an allowable range of timing when the sheet reaches a predetermined position of said image forming apparatus, wherein the operating data indicates an actual timing when the sheet reaches the predetermined position of said image forming apparatus, and wherein the synthetic data is data superimposing the reference data and the operating data on the same coordinate system.

10. The service person support method for an image forming system according to claim 9, wherein the at least one to-do item stored in the storage device is adapted to specify the details of an operation to be performed by the service person when a malfunction has occurred in the image forming apparatus.

11. The service person support method for an image forming system according to claim 9, wherein the at least one to-do item stored in the storage device specifies the details of an operation to be performed by the service person during a periodic inspection of the image forming apparatus.

12. The service person support method for an image forming system according to claim 9, wherein the storage device is externally and communicably connected to the central control unit.

13. The service person support method for an image forming system according to claim 9, wherein the storage device is incorporated in the central control unit.

14. The service person support method for an image forming system according to claim 9, wherein the reference data enables the image forming apparatus to perform an image forming operation under the operational environment of the image forming apparatus, and includes a representative value, an upper limit value, and a lower limit value.

15. The service person support method for an image forming system according to claim 9, wherein the central control unit is adapted to read out to-do items from the storage device in descending order of priority.

16. The service person support method for an image forming system according to claim 9, further comprising a transmission unit adapted to transmit a notification of correction of a malfunction, to the central control unit, and wherein the central control unit is adapted to update priorities of the respective to-do items stored in the storage device in response to receipt of the notification of correction of the malfunction.

* * * * *